United States Patent [19]

Kaufmann

[11] 4,423,894

[45] Jan. 3, 1984

[54] CARPET-KNOTTING INSTRUMENT

[76] Inventor: Gerda Kaufmann, Gottlieb-Daimler-Str. 3, 7809 Denzlingen, Fed. Rep. of Germany

[21] Appl. No.: 260,922

[22] Filed: May 6, 1981

[51] Int. Cl.[3] ..... D03J 3/00; B65H 69/04

[52] U.S. Cl. ..... 289/17; 38/102.91; 139/1 R; 289/18.1

[58] Field of Search ..... 289/1.5, 2, 17, 18.1; 38/102.4, 102.9, 102.91; 139/1 R, 4

[56] References Cited

U.S. PATENT DOCUMENTS

| | | | |
|---|---|---|---|
| 2,309,076 | 1/1943 | Morando | 38/102.91 X |
| 2,521,685 | 9/1950 | Block | 38/102.91 |
| 2,832,171 | 4/1958 | Batey | 38/102.91 |
| 2,873,766 | 2/1959 | Jeandupeux | 139/1 R |
| 3,415,558 | 12/1968 | Holzknecht | 289/18.1 |
| 4,182,527 | 1/1980 | Meehan | 289/1.5 |

FOREIGN PATENT DOCUMENTS

| | | | |
|---|---|---|---|
| 2735800 | 2/1979 | Fed. Rep. of Germany | 289/18.1 |
| 2746691 | 4/1979 | Fed. Rep. of Germany | 289/18.1 |
| 2,907,067 | 8/1980 | Fed. Rep. of Germany | 289/18.1 |

*Primary Examiner*—Louis Rimrodt

*Attorney, Agent, or Firm*—Shlesinger, Arkwright, Garvey & Fado

[57] ABSTRACT

The invention concerns a carpet knotting instrument (1) for canvases (4) wherein two canvas threads guided parallel to each other at a small spacing are arranged at a slight angle to each other so that an aperture is created thereby.

In order to render such a carpet knotting instrument universally applicable and to make to more reliable and easier to handle, such a carpet knotting instrument comprises the following features:

(a) a knotting needle (2) with an oblong needle eyelet (3), said needle being insertable between two canvas threads (5, 6; 7, 8) guided parallel to each other and at a small spacing, (b) drive means (9–21) for the two legs (27, 28) of the knotting thread (26) bent into the shape of a loop in order to guide the two legs from the two opposite sides of the needle eyelet (3) through same.

17 Claims, 7 Drawing Figures

Figure 1:
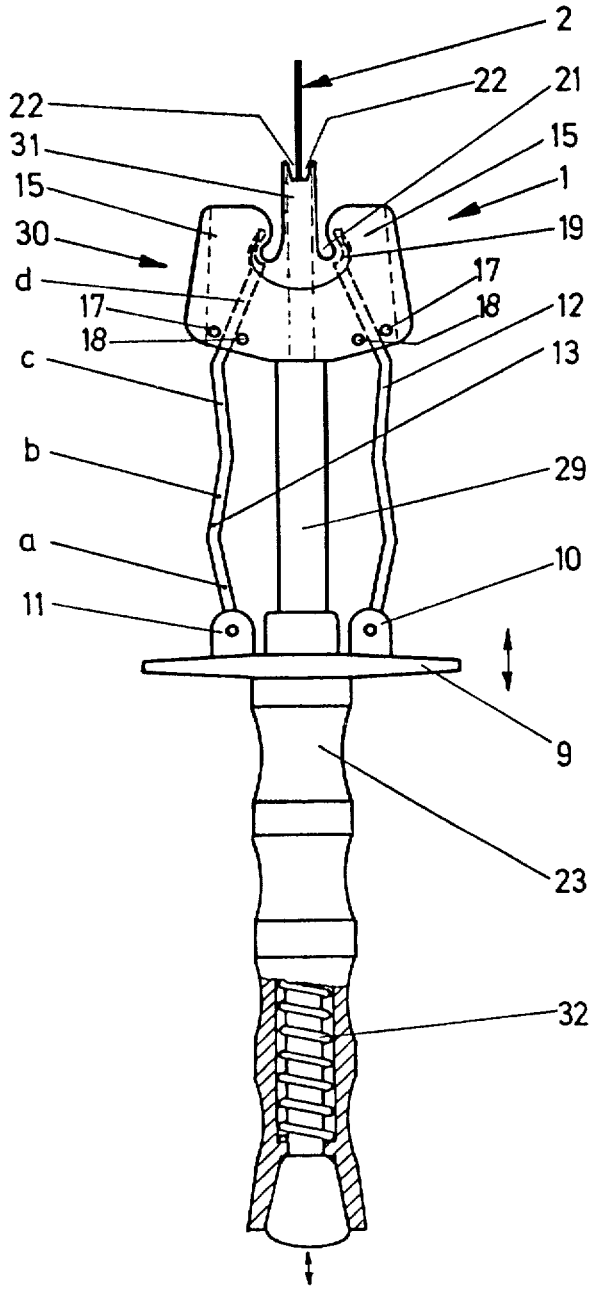

Fig. 4
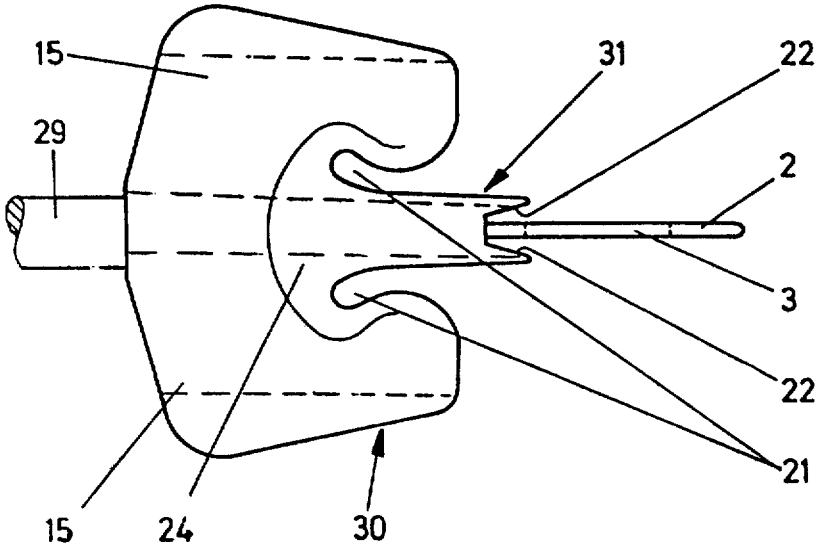
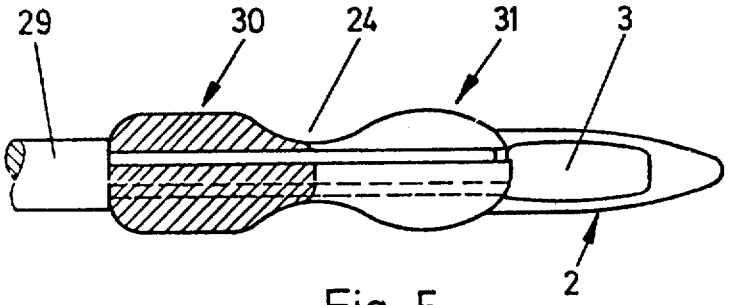
Fig. 5

CARPET-KNOTTING INSTRUMENT

The invention concerns a carpet knotting instrument as defined in the preamble of the claim 1.

Carpet knotting has become a popular hobby; the knotting instruments are used mostly by carpet-knotting hobbyists.

A main object of the invention is to so design a carpet-knotting instrument as defined by the preamble of the claim 1 that its operation shall be more rapid and less tiring.

Another object is to reduce the noise generated in the knotting process.

A still other object is to obtain a carpet-knotting instrument which can be used universally, that is for different canvas and for different wool grades.

Another object is to simplify and reduce the costs of manufacture.

The problem is solved by the characterizing features of claim 1. Further development of the invention are protected by the dependent claims.

A carpet-knotting instrument as defined by the preamble of the claim 1 comprises the following features under the object of the invention:

(a) a knotting needle (2) with an oblong needle eyelet (3), which can be inserted between two canvas threads (5, 6; 7, 8) guided parallel to each other and at a small spacing, (b) drive means (9–21) for the two legs of the knotting thread (26) bent in the manner of a loop in order to guide the two opposite sides of the needle eyelet (3) through this eyelet.

By mounting a prismatic means in the form of two grooves flaring forward and outward on the side of the attachment of the knotting needle to the knotting instrument, this knotting instrument following the passage of the knotting needle through the two slightly apart, parallelly guided canvas threads can be set upon these threads in a manner so determined that two apertures remain to the left and the right of the needle which are determined each by four double canvas threads guided so as to subtend an angle to each other.

When the carpet knotting instrument is actuated, one leg each of the knotting threads is bent into a loop shape, is moved through these apertures and passed crosswise through the needle eyelet below the canvas. In the ensuing retraction of the knotting needle, the two legs of the knotting thread are pulled through the narrow gap between the two parallel-guided canvas threads and guided upward, and the knot, which professionally is called the Ghiordes knot, is now finished.

On account of the specific magnitude of the flaring angle of the grooves as specified in the claims, the outer profile of the knotting needle defined therein and the special design of the needle eyelet, it is possible to apply the knotting instrument of the invention to the most diverse canvases and thread thicknesses and kinds. The angle between the crossing canvas threads of the canvas also is variable within very wide limits, even if conventionally these threads ordinarily are at right angles to each other.

Appropriately a knotting head is provided, which supports the needle and contains the drive means for the two legs of the knotting thread.

The knotting arms preferably consist of four essentially straight partial arms joined by rounded off transition pieces and subtending specific small angles between them. This makes it possible to guide the two legs of the knotting thread in optimal and jerk-free manner, in particular it is possible to implement an optimally crossed passage of the two legs of the knotting thread through the needle eyelet, the opening of this eyeley being utilized in optimal manner.

Appropriately the two knotting arms are joined in articulating manner to a mounting plate. This mounting plate advantageously may comprise a gripping handle of hollow design to form a guide means for the guide rod. Lastly a tension spring may be clamped into the said cavity to keep the mounting plate 9 and hence the guide arms joined thereto always in a rearward position so long as no stress is exerted against this spring force.

The knotting instrument is especially advantageous when used together with a special frame consisting of two side parts of which both ends comprise mutually facing inside threads adapted to matching threads of two connecting spindles. The upper edges of the side parts may comprise a plurality of serially arranged, externally pointing teeth. The side parts as well as the connection spindles may each be manufactured of a single piece from plastics, preferably polypropylene, by the injection molding method, whereby the manufacture becomes very simple and economical. Moreover the knotting head and the mounting plate may be made together with an integral gripping handle by the injection molding method. As regards the guide rod, the two knotting arms and the knotting needle, stainless steel is appropriately used.

The drawings shows an illustrative embodiment of the invention.

Figure 2:
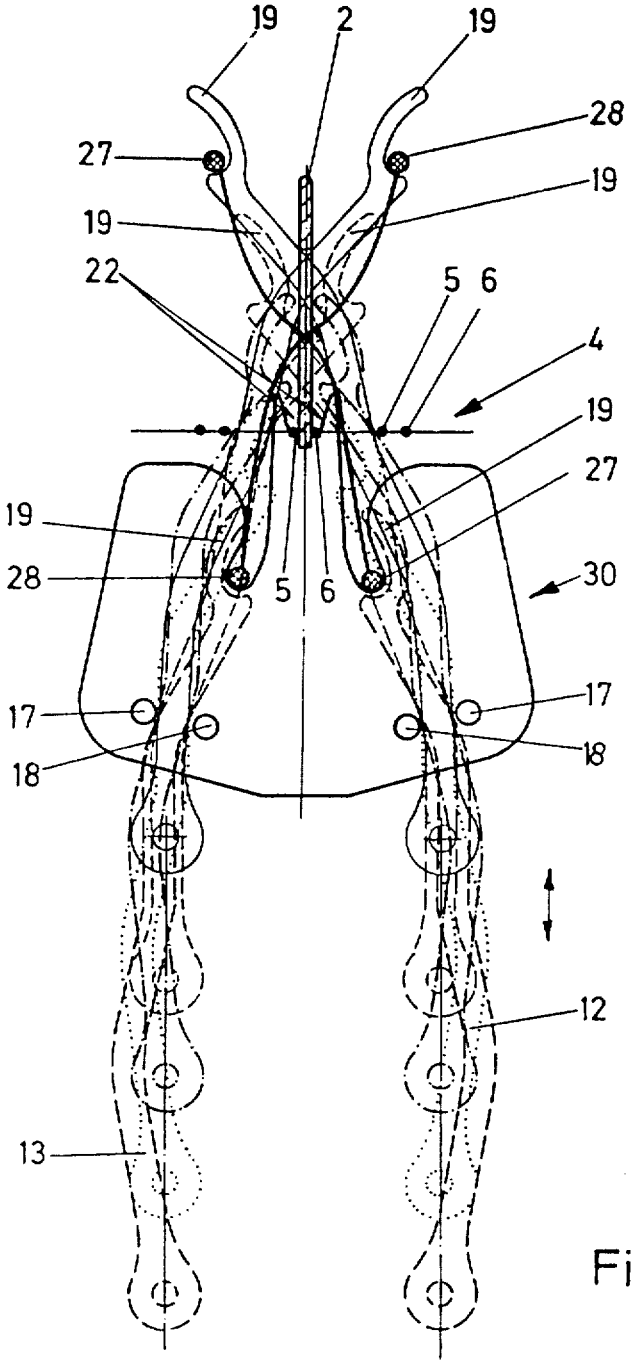
Figure 3:
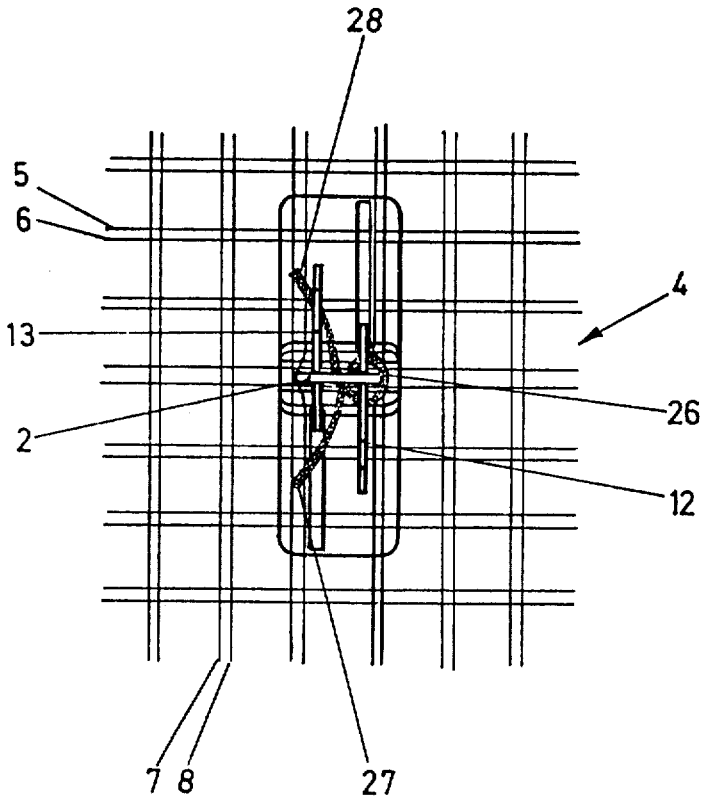
Figures 6, 7:
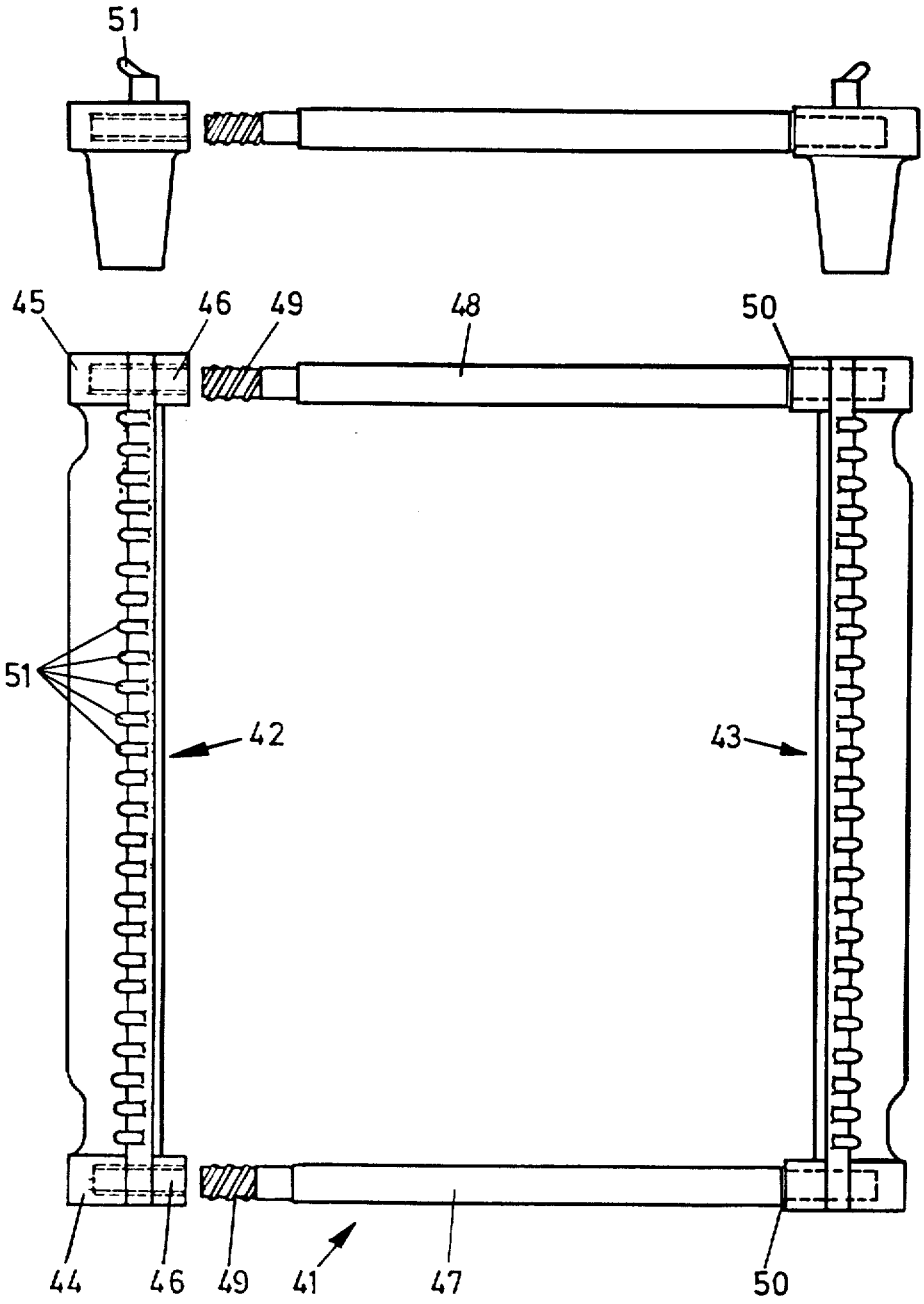

FIG. 1 is a top view of the carpet knotting instrument,

FIG. 2 is the sequence of motion of the opposite knotting arms following set-up of the knotting needle on the canvas, FIG. 3 is a top view of a canvas on which has been set the knotting needle, FIG. 4 is a top view on a larger scale of the knotting head, FIG. 5 is a sideview in section of the needle holder, FIG. 6 is a front elevational view of a knotting frame, FIG. 7 is a top view of a whole frame.

In FIG. 1 the carpet knotting instrument as a whole is denoted by 1, the knotting needle by 2. A mounting plate 9 with the gripping handle 23 is shown in the lower part of FIG. 1. A tension spring 32 is provided inside the gripping handle 23 and mounted to the periphery of the guide rod 23. The guide rod 29 is rigidly connected to the rear segment of the knotting head 30. Hinging bearings 10 and 11 for the two opposite knotting arms 12 and 13 are provided left and right of the guide rod 29, but slightly offset sideways (not shown in FIG. 1). These knotting arms 12 and 13 each consist of four straight segments alternatingly mounted at a small angle to the axis of the guide rod 29, a rounded off spacer (not shown in FIG. 1) being arranged between any two adjoining segments. The front end of the knotting arms 12 and 13 comprises drive hooks 19 for the knotting thread 26 (not shown in FIG. 1). The knotting arms 12 and 13 together with the gripping handle 23 and the mounting plate 9 can be lifted forward against the force of the tension spring 32 until the front end of the mounting plate 9 comes into contact with the rear segment of the knotting head 30. During this procedure, the guide rod 29 slides to the rear in the cavity of the gripping handle 23.

In the course of this motion, the knotting arms 12 and 13 are guided by outer guidance pins 17 and inner guidance pins 18 provided in the knotting head 30. Guidance slots 15 are provided at the left and right sides of the knotting head 30 within the dashed lines. It should be noted that the inside guidance slot extends as far as into the region of the needle holder 31. The FIG. 1 also shows the prism with the two grooves 21 flaring forward and outside. Lastly the FIG. 1 shows also sickle-shaped clearances 21 in the knotting head 30, which are open forward.

FIG. 2 shows the knotting head, the knotting arms 12 and 13 and the canvas 4 at various times in the course of motion during the knotting procedure. The grooves 22 of the knotting head 30 are seated from above on the canvas threads 5 and 6 in such a manner than apertures adjoining the canvas threads are the result, through which pass the knotting arms 12 and 13, at the tip the hooks 19. In cooperation with the guide slots (not shown), these hooks 19 push the legs 27 and 28 of the loop-like canvas thread through at the front. In the process, the knotting arms 12 and 13 are so guided by the opposite outer guidance pins 17 and the inside guidance pins 18 that the forward ends of the guide arms 12 and 13, which are formed by the hooks 19, move through the needle eyelet 3 next to the legs 27 and 28 guided at said arms and cross within said eyelet.

FIG. 3 shows the canvas 4 with the knotting needle set on it. The structure of the fabric with mutually perpendicular canvas threads 5 and 6, or 7 and 8 can be noted. Again one can note the sideways offset of the knotting arms 12 and 13. The figure furthermore outlines the knotting thread 26 with its loop-shaped upward bent legs 27 and 28 after these were crossed in the needle eyelet 3.

FIG. 4 is a topview of the knotting head 13 on an enlarged scale. Two slotted clearances 15 for the guide arms 12 and 13 (not shown) can be seen between the outer and inner dashed lines in the plastic main component of the knotting head 30, and on the left-hand side, the guidance rod 29. The figure moreover shows the needle holder 31 with the prism consisting of two grooves 22 flaring forward and outward. The needle 2 with the oblong needle eyelet 3 is located centrally between the two grooves 22. A sickle-shaped clearance 21 is located between the central needle holder 31 and each of the outsides of the flat knotting head 30, flaring toward the outsides and with a circular radius of about 10 mm. The width of the sickle-shaped clearances is such that the conventional grades of knotting threads used can easily be received therein. A recess 24 is provided near the base of the needle holder 31 for the finger tips, so that the legs of the knotting thread inserted into both clearances 21 can be fingerheld.

FIG. 5 is a section through the knotting head 30 with the guide rod 29 arranged behind and the needle holder 31 for the needle 2. The figure also indicates the sideways contour of the trough 24. FIG. 5 moreover clearly shows the forward rounding off of the needle holder 31, which preferably is somewhat circular. This facilitates the guidance of the two legs of the knotting thread 26 (not shown). Again the external contour of the knotting needle 2 and the needle eyelet 3 with its special inside profile are clearly shown in FIG. 5. The shape of the outer contour of the needle 2 can be described as being the junction of two arcs of circle with a radius of about 25 to 50 mm, the maximum width of the needle 2 being about 7 mm and being at a distance of about 13 mm from the rounded off tip. In this manner a surprisingly jerk-free and convenient way of inserting the needle in the narrow gaps between the parallel canvas threads is made possible, and also easy removal from this location.

The needle eyelet 3 is about 13 mm long and its maximum width is about 5 mm. The side surfaces are not straight, but rather form arcs of circle of about 20 to 45 mm radius. In this manner it became possible in surprising manner to use a single knotting instrument for threads of different thicknesses and for different kinds of canvases.

FIG. 6 shows a front view of a frame including a spindle (47) comprising a matching thread (49) at the left side. In addition, at the left and at the right side two ends (44,45) of the frame (41) are shown. On the two side parts (42,43) of the frame (41) two teeth (51) are shown. FIG. 7 shows a frame 41 for clamping the canvas 4. This frame consists of two identical side parts 42 and 43 and of two also identical connecting spindles 47 and 48. These two parts can be prepared preferably integrally by means of the injection molding process and be made of plastic, preferably polypropylene. The upper ends of the side parts 42 and 43 comprise inside threads in the axial direction so that the connection spindles 47 and 48, the corresponding outer threads 49 and 50 can be screwed thereon. The upper edges of the side parts 42 and 43 comprise a plurality of teeth 51 extending upward and somewhat outwardly at a slant.

To clamp the canvas, the screwed-together frames 41 first are brought into a narrow position, whereupon the canvas apertures arranged in a row are forced over the individual teeth 51 and the frame is tensioned thereafter by correspondingly widening the side parts by rotating the connecting spindles 47 and 48. To simplify this rotation, these spindles may comprise longitudinal ribs.

Using this described frame, it is possible to easily insert and tension the canvas. Such a frame can be manufactured easily and economically and is applicable to different canvases. Moreover it offers the further advantage of being very compact when disassembled, simplifying storage and shipment.

The operation of the carpet knotting instrument of the object of the invention will be discussed below especially in relation to FIG. 2. First a knotting thread, preferably from a conventional knitting wool and about 3 mm in diameter, is bent into a loop. The two loop legs are guided around the knotting needle 2 and spring holder 31 in the two opposite clearances 21 and are finger-held at the rear side at the trough 24. Thereupon the knotting head 30 is so set by means of the prism on the canvas 4 that the two opposite grooves 22 are each seated on one of the two parallel canvas threads 5 and 6 arranged at a slight mutual distance. Thereupon the two mutually opposite knotting arms 12 and 13 are guided down, by moving the gripping handle 23, until they hit. In this manner the legs 27 and 28 of the knotting thread 26 are guided through the apertures of the canvas 4 which are next to the prism. This guidance is such that the legs are guided directly underneath the surface of the canvas 4 through the needle eyelet 3, whereby the two legs 27 and 28 are crossed in the end position. If now the entire knotting instrument including the needle 2 is retracted again, the two legs 27 and 28 are guided upward through the small spacing between the two parallel-arranged canvas threads 5 and 6 in such a manner that a genuine Ghiordes knot results, the same as for the genuine Persian carpets, namely originally by means of laborious manual labor, later by complex machinery in plants.

I claim:

1. A carpet knotting apparatus for use in combination with a canvas or the like having successive pairs of spaced parallel threads with a clearance between the threads of each pair, comprising:

a. a guidance rod having a pair of opposed ends;

b. a mounting plate slideably mounted to one of said ends and adapted for reciprocable displacement longitudinally of said guidance rod;

c. a knotting head secured to said other end of said guidance rod and having a longitudinally projecting needle holder;

d. a knotting needle having a pair of generally parallel sides and a generally oblong shaped eyelet therethrough secured to said needle holder and extending longitudinally therefrom;

e. knotting thread positioning means disposed on said knotting head for positioning a loop of knotting thread with a pair of ends adjacent said knotting needle;

f. a pair of guidance slots disposed on either side of said knotting needle and associated with said knotting head and each of said guidance slots having guide means;

g. thread positioning means disposed on said needle holder for positioning said needle holder on one of said pairs of threads;

h. a pair of spaced cooperating legs articulably mounted to said mounting plate and displaceable therewith and each leg extending from said mounting plate to an associated one of said guiding slots and adapted for being guided by said guide means;

i. each of said legs having a hook end adapted for engaging and pulling an associated one end of said loop of knotting thread; and, j. whereby longitudinal displacement of said mounting plate toward said knotting head displaces each of said legs and said hook ends with engage and pull an associated end of said loop of knotting thread through said eyelet for knotting said loop of knotting thread.

2. A carpet knotting apparatus as in claim 1, wherein:

a. said knotting thread positioning means including a pair of generally sickle-shaped clearances, each of said clearances being disposed adjacent an associated side of said knotting needle.

3. A carpet knotting apparatus as in claim 2, wherein:

a. said thread positioning means including a pair of cooperating grooves, each of said grooves being disposed adjacent an associated side of said knotting needle.

4. A carpet knotting apparatus as in claim 3, wherein:

a. said guide means including two pair of spaced cooperating pins, each of said pair of pins being associated with one of said guidance slots; and, b. each of said legs having a portion disposed between an associated pair of pins.

5. A carpet knotting apparatus as defined in claim 4, further comprising:

a. a handle secured to said mounting plate and displaceable therewith.

6. A carpet knotting apparatus as defined in claim 5, wherein:

a. said handle having a longitudinally extending aperture; and, b. said guidance rod traversing said handle aperture.

7. A carpet knotting apparatus as defined in claim 6, further comprising:

a. a spring co-axially mounted to said guidance rod and disposed within said handle aperture for maintaining said mounting plate at a distance from said knotting head.

8. A carpet knotting apparatus as defined in claim 4, further comprising:

a. said knotting head being hollow; and, b. said knotting head having a pair of outer contoured surfaces adapted for being gripped by fingers for holding said loop of knotting thread.

9. A carpet knotting apparatus as defined in claim 8, wherein:

a. at least a portion of each of said legs being disposed within said hollow knotting head.

10. A carpet knotting apparatus as defined in claim 9, wherein:

a. said knotting head having a forward end and a rearward end; and, b. said pins being associated with said rearward end and said sickle-shaped clearances being associated with said forward end.

11. A carpet knotting apparatus as defined in claim 10, wherein:

a. said knotting needle having a forward end and a rearward end; and, b. said pair of grooves being associated with said rearward end.

12. A carpet knotting apparatus as defined in claim 3, wherein:

a. said grooves each flaring forwardly towards said knotting needle; and, b. said grooves flaring at an angle to said guidance rod of between approximately 10° to 20°.

13. A carpet knotting apparatus as defined in claim 1, wherein:

a. said knotting needle having an outer tip and a generally arcuate periphery extending therefrom; and, b. said knotting needle periphery having a width of approximately 5 mm to 9 mm at a distance of approximately 10 mm to 16 mm from said tip.

14. A carpet knotting apparatus as defined in claim 13, wherein:

a. said needle eyelet having a pair of longitudinal sides;

b. each of said longitudinal side being generally arcuate with a radius of generation of approximately 20 mm to approximately 45 mm; and, c. said eyelet having rounded corners.

15. A carpet knotting apparatus as defined in claim 1, wherein:

a. said legs being offset relative to each other for being displaceable in spaced parallel planes.

16. A carpet knotting apparatus as defined in claim 1, further comprising:

a. said legs each having four connected portions;

b. a first one of said portions having one end pivotably mounted to said mounting plate and extending longitudinally therefrom at an outward angle of approximately 10° relative to said guidance rod;

c. a second one of said portions connected to said longitudinally extending portion of said first rod and extending longitudinally therefrom at an inward angle of approximately 10° relative to said guidance rod;

d. a third one of said portions connected to said longitudinally extending portion of said second portion and extending longitudinally therefrom at an outward angle of approximately 5° relative to said guidance rod; and, e. a fourth one of said portions connected to said longitudinally extending third portion and extending longitudinally therefrom at an inward angle of approximately 20° relative to said guidance rod.

17. A carpet knotting apparatus as defined in claim 16, further comprising:

a. a pair of spaced offset bearings secured to said mounting plate; and, b. each of said legs articulably mounted to an associated one of said bearings.

* * * * *